US010165876B2

(12) United States Patent
Gaffney

(10) Patent No.: US 10,165,876 B2
(45) Date of Patent: Jan. 1, 2019

(54) FLORAL DISPLAY BOX

(71) Applicant: Michael Gaffney, Mantua, OH (US)

(72) Inventor: Michael Gaffney, Mantua, OH (US)

( * ) Notice: Subject to any disclaimer, the term of this patent is extended or adjusted under 35 U.S.C. 154(b) by 155 days.

(21) Appl. No.: 15/248,558

(22) Filed: Aug. 26, 2016

(65) Prior Publication Data

US 2017/0055733 A1 Mar. 2, 2017

Related U.S. Application Data

(60) Provisional application No. 62/210,034, filed on Aug. 26, 2015.

(51) Int. Cl.
*A47G 7/07* (2006.01)

(52) U.S. Cl.
CPC ..... *A47G 7/07* (2013.01)

(58) Field of Classification Search
CPC ..... A47G 7/07
USPC ..... D11/147
See application file for complete search history.

(56) References Cited

U.S. PATENT DOCUMENTS

| | | | | |
|---|---|---|---|---|
| 2,062,684 | A * | 12/1936 | Thomas | A47G 7/06 27/1 |
| 3,158,524 | A * | 11/1964 | Tong | A41G 1/00 206/423 |
| 3,498,520 | A * | 3/1970 | Gronewold | B65D 81/36 206/589 |
| 3,745,702 | A * | 7/1973 | Ogawa | A47G 7/07 211/60.1 |
| 4,606,950 | A | 8/1986 | Corbet | |
| 4,958,461 | A * | 9/1990 | Aldrich | A47G 7/02 47/41.01 |
| 5,375,370 | A | 12/1994 | Zimmerman | |
| 5,758,452 | A | 6/1998 | Matteucci et al. | |
| 5,853,827 | A * | 12/1998 | Wise | A01G 5/04 428/23 |
| 6,189,261 | B1 | 2/2001 | Helgeson | |
| D446,749 | S * | 8/2001 | Graves | D11/147 |
| 7,000,347 | B2 | 2/2006 | Roskin | |
| 7,096,623 | B2 * | 8/2006 | Cardamone | A01G 5/04 47/41.01 |
| 8,708,166 | B1 * | 4/2014 | Crouch | A01G 5/04 211/181.1 |
| 9,629,486 | B2 * | 4/2017 | Allan | A01G 5/04 |
| 2005/0091917 | A1 | 5/2005 | Brennan | |
| 2006/0265951 | A1 | 11/2006 | Foster | |
| 2013/0047502 | A1 | 2/2013 | Wargo | |

* cited by examiner

*Primary Examiner* — Monica L Williams
(74) *Attorney, Agent, or Firm* — Daniel M. Cohn; Howard M. Cohn

(57) ABSTRACT

An improved floral display box to house flowers. The floral display box includes a vase for arranging a plurality of flowers having an open top, a closed bottom, and one or more side walls. The vase is adapted to house the flowers and accompanying water and nutrients. Further, a lid is removably disposed over the open top of the vase. The lid has a plurality of openings disposed therethrough to hold the flower in place within the vase, the plurality of holes having a diameter of about 0.1 and 1 cm and being disposed at an angle of about 20 degrees to about 45 degrees with respect to a centerline from a centrally place opening in the lid to the bottom surface of the vase to a centerline through outermost holes in the lid to the bottom surface of the vase.

13 Claims, 4 Drawing Sheets

FLORAL DISPLAY BOX

CROSS-REFERENCE TO RELATED APPLICATIONS

This application claims the benefit of U.S. Provisional Patent Application No. 62/210,034 filed on Aug. 26, 2015, which is incorporated in its entirety herein by reference.

TECHNICAL FIELD OF THE INVENTION

The present invention relates generally to an improved floral display box. More specifically, the present invention relates to a vase for arranging a plurality of flowers having an open top, a closed bottom, and one or more side walls.

BACKGROUND OF THE INVENTION

Cut flowers and greens have been used for decorations for many centuries. As is well known by most people, cut flowers and greens remain alive and beautiful for a significant period of time if they are placed in water while being displayed. As such, most cut flowers are typically displayed in a vase or some other container that is designed to hold both the flowers and a volume of water that surrounds the cut sterns of the flowers.

Over the years, the art of floral design has developed into a sophisticated art form. In floral design, flowers and greens are placed in arrangements according to their color, size, flower type and shape. However, in order to create an aesthetically pleasing arrangement, flowers and greens must be set into a designed arrangement so that both the flowers and greens remain erect, oriented and properly spaced. Flowers and greens are not just randomly combined and displayed. Rather, great care is taken to place each flower and each green into a particular position that enhances the beauty of the overall display.

SUMMARY OF THE INVENTION

According to an embodiment of the present invention, there is disclosed an improved floral display box to house flowers. The floral display box includes a vase for arranging a plurality of flowers having an open top, a closed bottom, and one or more side walls. The vase is adapted to house the flowers and accompanying water and nutrients. Further, a lid is removably disposed over the open top of the vase. The lid has a plurality of openings disposed therethrough to hold the flower in place within the vase, the plurality of holes having a diameter of about 0.1 and 1 cm and being disposed at an angle of about 20 degrees to about 45 degrees with respect to a centerline from a centrally place opening in the lid to the bottom surface of the vase to a centerline through outermost holes in the lid to the bottom surface of the vase.

According to another embodiment of the present invention, there is disclosed a method of housing flowers in a floral display box. The method includes providing a vase having an open top, a closed bottom, and one or more side walls, and placing water into the closed bottom of the vase. Then, covering the closed bottom of the vase with a removable lid having a plurality of openings extending therethrough. Finally, placing the stems of a plurality of flowers through the openings son that the stems of the flowers extend along a centerline through the opening and into the closed bottom so that the stems extend at an angle of about 20 degrees to 45 degrees to a centerline through a centrally placed opening in the lid to the bottom surface of the vase.

BRIEF DESCRIPTION OF THE DRAWINGS

The structure, operation, and advantages of the present invention will become further apparent upon consideration of the following description taken in conjunction with the accompanying figures (FIGS.). The figures are intended to be illustrative, not limiting. Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

In the drawings accompanying the description that follows, both reference numerals and legends (labels, text descriptions) may be used to identify elements. If legends are provided, they are intended merely as an aid to the reader, and should not in any way be interpreted as limiting.

DETAILED DESCRIPTION OF THE PREFERRED EMBODIMENTS

Figure 1:
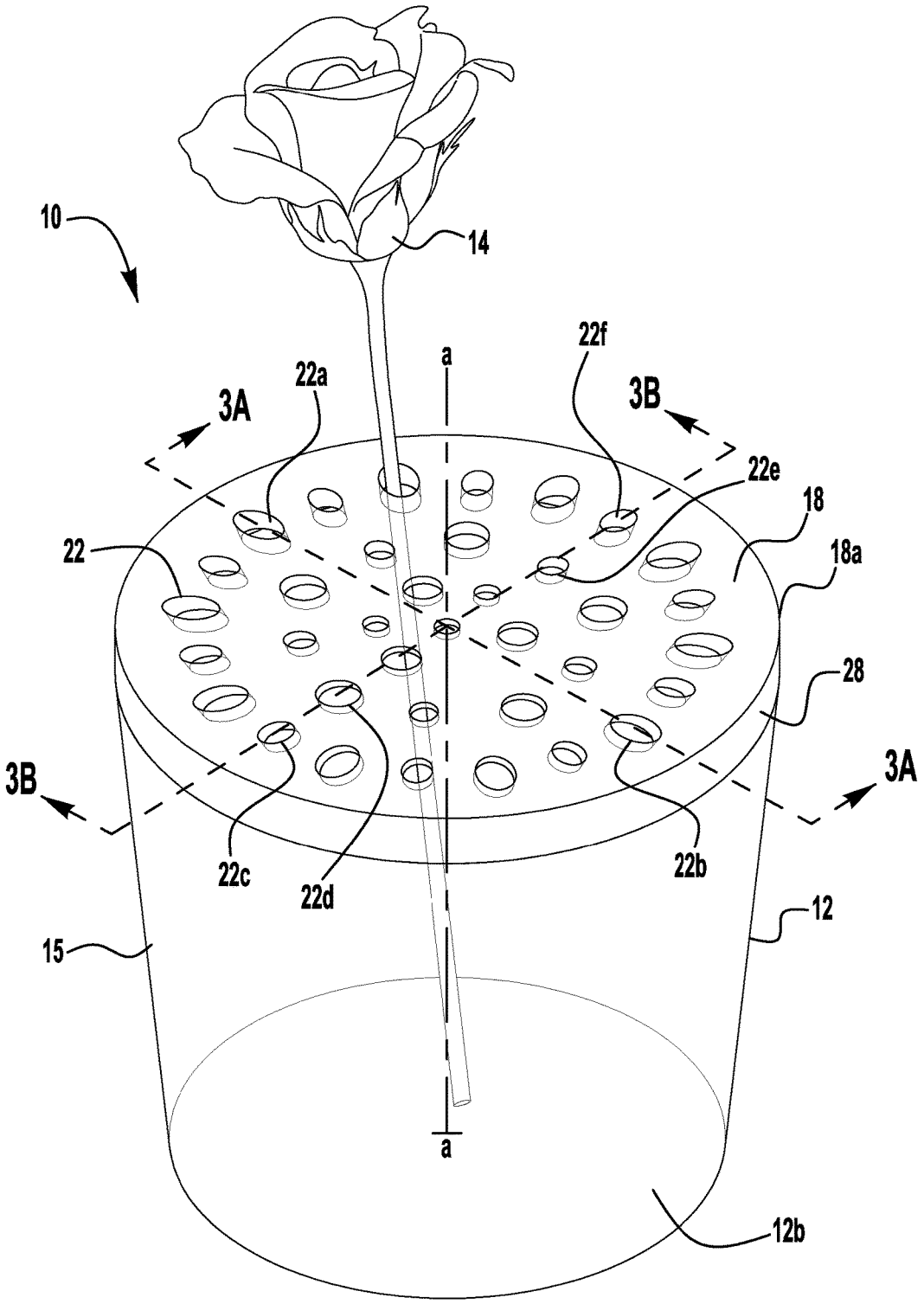
FIG. 1 is a front three dimensional view of the floral display box, in accordance with the present invention.

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

In the drawings accompanying the description that follows, often both reference numerals and legends (labels, text descriptions) will be used to identify elements. If legends are provided, they are intended merely as an aid to the reader, and should not in any way be interpreted as limiting.

Most often, cut flowers and greens are placed in vases. A vase is a container or box with an open top. Vases come in a large variety of sizes shapes and designs. However, in most cases, the vase presents a single top opening into which flowers and greens are placed. When arranging flowers in a vase, little holds each flower in place other than the tangle of the cut sterns in the confined space of the vase. Consequently, flowers and green often move out of position in a vase, especially if the vase is moved or the flowers are inadvertently touched.

As is well known, a novice in the art of floral arrangements must struggle or ask for help when arranging flowers in a vase or another container, so as to offer a symmetrical and pleasing arrangement. The improved floral display box 10 is designed to provide a vase or container 12 that easily and quickly arranges a plurality of flowers 14 therewithin. The floral display box 10 incorporates principles of mathematics and science to provide aesthetically pleasing flower arrangements 16, as seen in FIG. 4.

FIG. 1 illustrates a three-dimensional view of the improved floral display box or container 10. As displayed in FIG. 1 and FIG. 2, the floral display box 10 can utilize a cylindrical-shaped vase 12, with an open top 12*a* and a closed bottom 12*b*, which typically holds water and other flower nutrients when in use, and a side wall 15. However, it should be noted that vases 12 of any desired shapes may be utilized, such as a rectangular-shaped vase 13 with an open top 13*a*, a closed bottom 13*b*, and sides 17*a*, 17*b*, 17*c*, and 17*d* (17*a*-17*d*) as seen in FIG. 4. Regardless of whether a cylindrical-shaped vase 12 or rectangular-shaped vase 13, or any other appropriate shaped vase is employed, the functionality remains the same. Further, the floral display box utilizes a circular lid 18 or a square lid 20, complete with a plurality of openings 22 and 24, respectively, which fit over the open top 12*a* of the cylindrical-shaped vase 12 or open top 13*a* of the rectangular-shaped vase 13, respectively.

The vase 12 may be constructed of any desired material, although an inexpensive and lightweight plastic polymer is the preferred material. The vase 12 may further be of any desired dimensions. For example, the rectangular-shaped vase 13, as seen in FIG. 4, may have a height with a range between six inches and twelve inches, and a width with a range between six inches and twelve inches. The cylindrical-shaped vase 12 as seen in FIG. 1, may have a height with a range between six inches and twelve inches, and a diameter with a range between six inches and twelve inches. A decorative pattern, such as a color and/or an embossed pattern and/or a hologram and/or other decorative surface ornamentation may be applied to the vases 12 and 13. Alternatively, the vases 12 and 13 may be totally clear or partially clear or a tinted transparent material.

Figure 2:
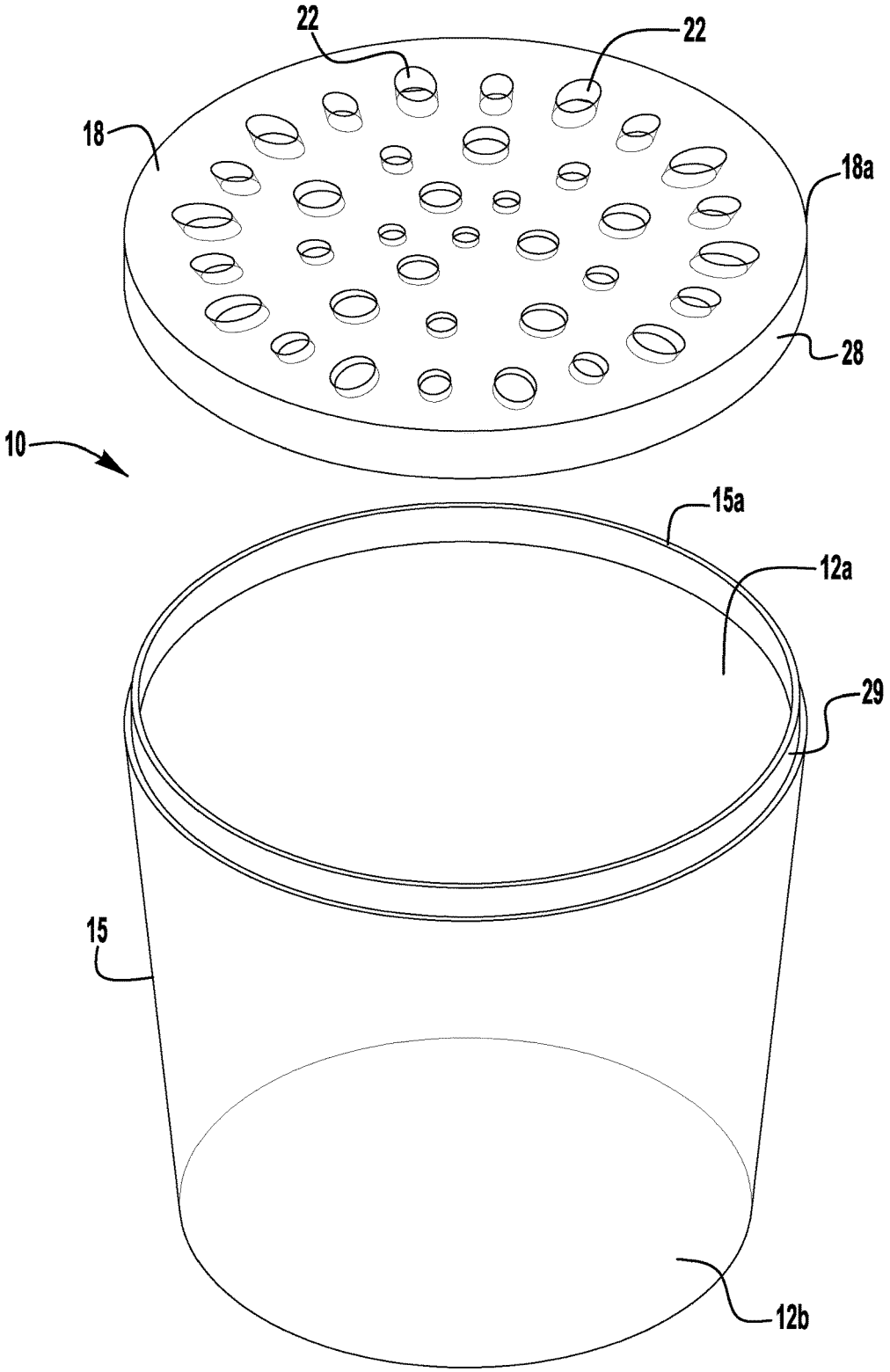
FIG. 2 is an exploded view of the floral display box, in accordance with the present invention.
Figure 4:
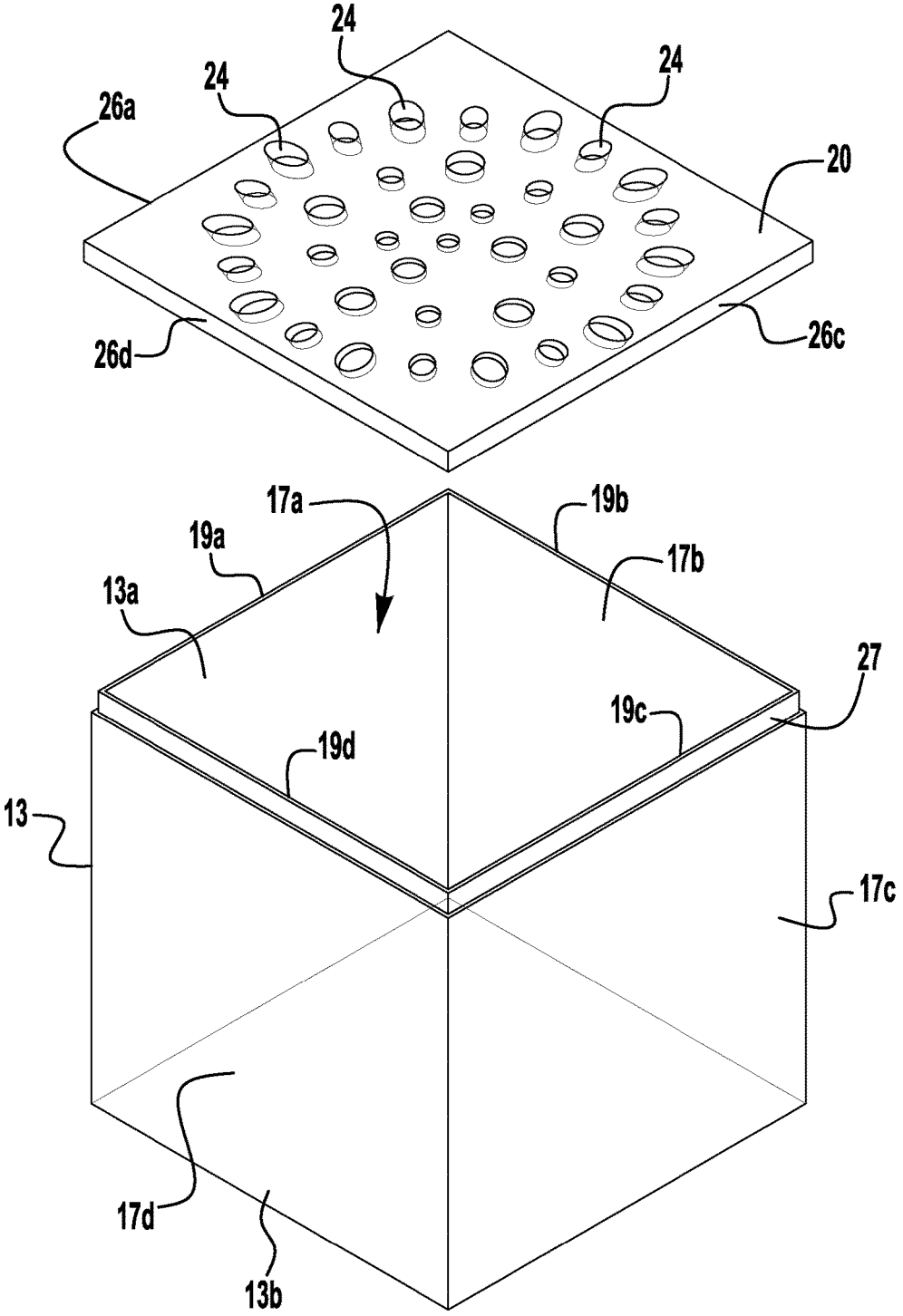
FIG. 4 is an exploded view of a second embodiment of the floral display box, in accordance with the present invention.

As illustrated in FIGS. 2 and 4, there is a circular lid 18 and square lid 20, complete with a plurality of openings 22 and 24, respectively. The flowers 14 are inserted through the openings 22 and 24 to form floral. The lids 18 and 20 are preferably comprised of a rigid plastic sheet, although any desired material may be utilized, which is approximately the size of the opening 12*a* of either the cylindrical-shaped vase 12, as seen in FIG. 1, or the opening 13*a* of the rectangular-shaped vase 13, as seen in FIG. 4.

The lids 18 and 20 are formed to be removably disposed over the open tops 12*a* and 13*a* of the vases 12. and 13, respectively. Circular lid 18 extends over the open top 12*a* of the cylindrical-shaped vase 12 formed within the top 15*a* of the side wall 15. Typically, there is a wall 28 extending about the diameter 18*a* of the circular lid 18. There is a lip 29 which extends about the top 15*a* of the side wall 15. The wall 28 is the same dimensions as the lip 29 and is disposed over the lip, such that the lid 18 is removably secured to the cylindrical-shaped vase 12.

Similarly, square lid 20 extends over the open top 13*a* of the rectangular-shaped vase 13 formed within the tops 19*a*, 19*b*, 19*c*, and 19*d* (19*a*-19*d*) of the four side walls 17*a*-17*d*. Typically, there are four walls 26*a*, 26*b*, 26*c*, and 26*d* (26*a*-26*d*) extending from the edges 20*a*, 20*b*, 20*c*, and 20*d* of the square lid 20. There is a lip 27 which extends about the tops 19*a*-19*d* of the four side walls 17*a*-17*d*. The walls (26*a*-26*d*) are the same dimensions as the lip 27 and are disposed over the lip, such that the lid 20 is removably secured to the rectangular-shaped vase 13. The walls 28 of the circular lid 18 and walls 26*a*-26*d* of square lid 20 are designed to temporarily secure the lids 20 and 18 to the rectangular-shaped vase 13 and the cylindrical-shaped vase 12, respectively. It should be further noted that an adhesive may be used to further secure the lids 18 and 20 to the vases 12 and 13, respectively.

Figure 3A:
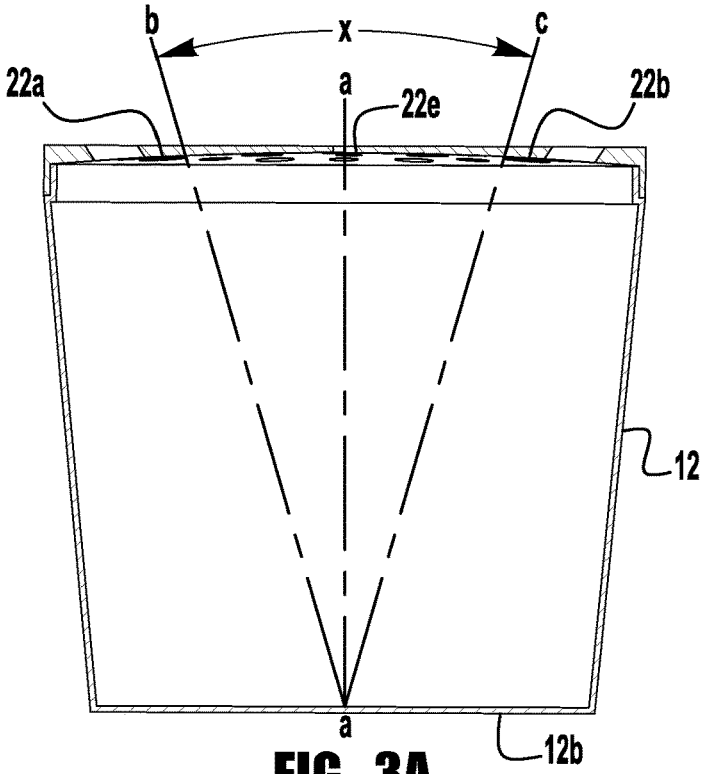
FIG. 3A is a cross-sectional view of first embodiment of a lid of the floral display box, in accordance with the present invention.
Figure 3B:
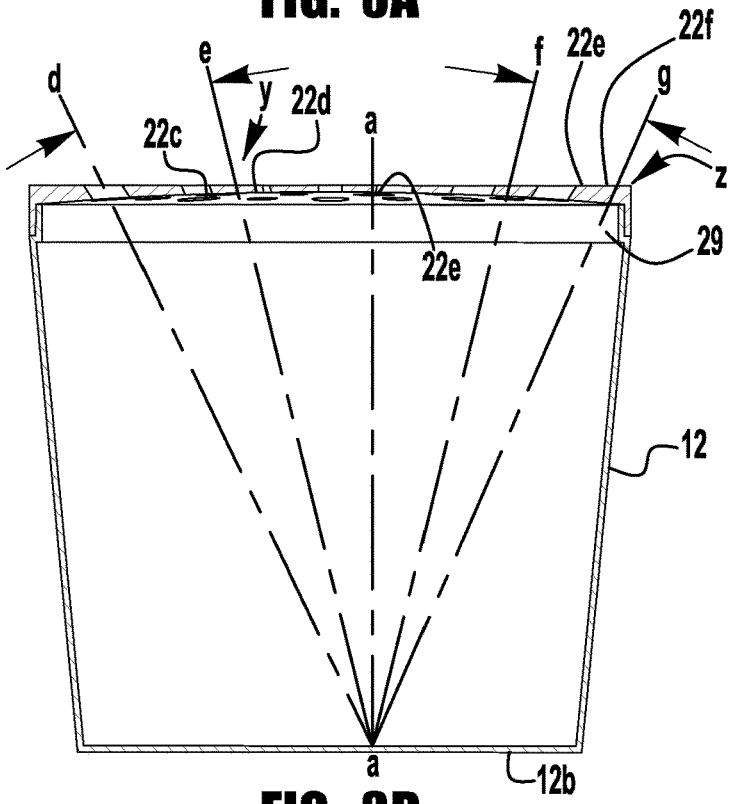
FIG. 3B is a cross-sectional view of second embodiment of a lid of the floral display box, in accordance with the present invention.

As seen in FIGS. 3A and 3B, there may be a multitude of interchangeable lids 18 and 18*bb*, designed to fit the cylindrical-shaped vase 12, each with a different arrangement of openings 22. It should be noted that there may also be a variety of interchangeable lids for the rectangular-shaped vase 13. In this manner, each of the vases 12 and 13 is versatile and may be utilized to display a variety of floral arrangements 16. For example, lids 18 and 20 may consist of large and medium openings between about 0.4 and 2 cm., lids 18 and 20 may consist of only medium sized openings 22 and 24 between about 0.4 and about 0.6 cm, and lids 18*b* and 20*b* may consist of medium and small sized openings 22 and 24 between about 0.1 and 0.6 cm. Further, each of the various interchangeable lids 18, 18*b*, 20, and 20*b* may incorporate openings with varying sizes so as to display flowers 14 of a variety of sizes.

As shown in FIGS. 3A and 3B, a centerline a-a extends through the vase 12 from a centrally place opening 22*e* to the bottom 12*b* of the vase. A centerline a-b and a-c from base 12*b* through outermost holes 22*a* and 22*b* respectively, are at an angle of about 20 degrees to about 45 degrees with respect to the centerline a-a. As shown in FIG. 3B, a centerline a-d and a-e from base 12*b* through holes 22*c* and 22*d* respectively, and centerline a-f and a-g through openings 22*e* and 22*f* are at an angle y and z, respectively, of about 05 degrees to about 15 degrees with respect to each other the centerline a-a. Then angle of the openings with respect to each other can be arranged to provide for various floral arrangements.

The openings 22 and 24 may be arranged in any desired fashion. As noted above, the openings 22 and 24 may be of a variety of shapes and sizes to accommodate flowers 14 of differing sizes, as well as to form differing floral arrangements. The openings 22 and 24 are specifically angled to guide flowers 16 across the containers 12 and 13 to create specifically shaped floral arrangements 16. When completed, they create a professional and aesthetically pleasing design. The depth and width of the openings 22 and 24 incorporate specifically designed dimensions and angles which are integral to the products design.

In use, the flowers 16 are inserted through the openings 22 and 24 within the lids 18 and 20, to form floral arrangements within the vases 12 and 13.

Although not illustrated, it is within the terms of the embodiment that each f the holes 22. and 24 be identifiable by a specific code, such that instructions on how to arrange a certain type of floral spray or bouquet may be published, or a record of past floral arrangements may be filed away for future use. The code used in the preferred embodiment employs letters for identifying each horizontal row and numbers for identifying each vertical column. Other codes may be used, for example printing each aperture scoring with an individual number or letter, or by identifying columns and rows, or even sections or groups of several apertures, by different colors or by some type of symbol.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. An improved floral display box to arrange a plurality of flowers therewithin to provide aesthetically pleasing flower arrangements, comprising:

a cylindrical-shaped, hollow vase for arranging the plurality of flowers having an open circular top, a closed bottom, and a side wall, a void region defined by the closed bottom and the side wall whereby the vase is adapted to house the plurality of flowers and accompanying water and nutrients;

a circular flat lid removably disposed over the open circular top of the vase, a void region defined by the closed bottom, the sidewall and the circular flat lid ; and the circular flat lid having a plurality of openings each having a diameter of between about 0.1 and 2 cm disposed therethrough to hold each flower of the plurality of flowers in place within the vase, a centerline through the plurality of openings being disposed at an angle of about 20 degrees to about 45 degrees with respect to a centerline from a centrally placed opening in the lid to the center of the closed bottom of the vase to a centerline through outermost openings in the circular flat lid to the center of the closed bottom of the vase whereby stems of the plurality of flowers placed through the plurality of openings extend along the centerline extending through the openings to the center of the closed bottom so that the sterns extend at an angle of about 20 degrees to about 45 degrees to the centerline through the centrally placed opening in the circular flat lid to the center of the bottom surface of the vase.

2. The floral display box of claim 1 wherein the lid includes large openings between about 0.6 and 2 cm. in diameter, medium sized openings between about 0.4 and about 0.6 cm. in diameter and small sized openings between about 0.1 and 0.4 cm. in diameter.

3. The floral display box of claim 1 wherein the open top of cylindrical-shaped, hollow vase is fanned within a top of the side wall.

4. The floral display box of claim 3 wherein a lip extends about the open top of the side wall to accommodate the circular lid.

5. The floral display box of claim 4 wherein a wall extends about a circumference of the circular lid which extends over the open top of the sidewall, whereby the wall is disposed over the lip, such that the circular lid is removably secured to the cylindrical-shaped, hollow vase.

6. The method of arranging a plurality of flowers and stems in a floral display box for providing aesthetically pleasing flower arrangements, comprising:

providing a hollow vase having an open top, a closed bottom, and one or more side walls, and a void region defined by the closed bottom and the one or more side walls whereby the vase is adapted to house the plurality of flowers and accompanying water and nutrients;

placing water into the closed bottom of the hollow vase;

covering the open top of the vase with a removable flat lid having a plurality of openings extending therethrough;

placing the stems of a plurality of flowers through the openings so that the stems of the flowers extend along a centerline through the opening and into the closed bottom so that the stems extend at an angle of about 20 degrees to 45 degrees to a central centerline through a centrally placed opening in the lid and to the closed bottom of the hollow vase.

7. The method of claim 6 including providing the removable lid with large openings between about 0.6 and 2 cms. in diameter, medium sized openings between about 0.4 and about 0.6 cms. in diameter and small sized openings between about 0.1 and 0.4 cms. in diameter.

8. The method of claim 6 further including providing the hollow vase having a cylindrical shape and the flat lid having a circular shape.

9. The method of claim 6 further including providing the hollow vase having a rectangular shape and the flat lid having a square shape.

10. An improved floral display box to arrange a plurality of flowers therewithin to provide aesthetically pleasing flower arrangements, comprising:

a rectangular-shaped, hollow vase for arranging the plurality of flowers having an open rectangular top, a closed bottom, and four side walls, a void region defined by the closed bottom and the four side walls whereby the vase is adapted to house the plurality of flowers and accompanying water and nutrients;

a rectangular flat lid removably disposed over the open rectangular top of the vase, a void region defined by the closed bottom, the four side walls and the rectangular flat lid ; and the rectangular flat lid having a plurality of openings each having a diameter of between about 0.1 and 2 cm disposed therethrough to hold each flower of the plurality of flowers in place within the vase, a centerline through the plurality of openings being disposed at an angle of about 20 degrees to about 45 degrees with respect to a centerline from a centrally placed opening in the lid to the center of the closed bottom of the vase to a centerline through outermost openings in the rectangular flat lid to the center of the closed bottom of the vase whereby stems of the plurality of flowers placed through the plurality of openings extend along the centerline extending through the openings to the center of the closed bottom so that the stems extend at an angle of about 20 degrees to about 45 degrees to the centerline through the centrally placed opening in the rectangular flat lid to the center of the bottom surface of the vase.

11. The floral display box of claim 10 wherein the open top of the rectangular-shaped vase is formed between tops of the four side walls.

12. The floral display box of claim 11 wherein a lip extends about the tops of the four side wails to accommodate the rectangular lid.

13. The floral display box of claim 12 wherein the rectangular lid which is removably disposed over the open top of the rectangular-shaped vase is square.

* * * * *